US005099642A

United States Patent [19]

Räder et al.

[11] Patent Number: 5,099,642

[45] Date of Patent: Mar. 31, 1992

[54] THREADING A FRICTION FALSE TWISTING UNIT

[75] Inventors: Wolfgang Räder; Friedrich Schuster; Walter Hinn, both of Hammelburg; Wilhelm Mang, Eschau/Hobbach, all of Fed. Rep. of Germany

[73] Assignee: Fag Kugel Fischer Georg Schafer, Fed. Rep. of Germany

[21] Appl. No.: 626,755

[22] Filed: Dec. 13, 1990

[30] Foreign Application Priority Data

Dec. 13, 1989 [DE] Fed. Rep. of Germany ..... 3941073

[51] Int. Cl.[5] ..... D02G 1/04; D02G 1/08

[52] U.S. Cl. ..... 57/339; 57/337; 57/338; 57/348

[58] Field of Search ..... 57/337-339, 57/348

[56] References Cited

U.S. PATENT DOCUMENTS

| | | | |
|---|---|---|---|
| 3,287,890 | 11/1966 | McIntosh et al. | 57/339 |
| 3,872,661 | 3/1975 | Eaves | 57/339 |
| 3,932,985 | 1/1976 | Naylor | 57/339 |
| 4,333,308 | 6/1982 | Schleyer et al. | 57/339 |
| 4,442,664 | 4/1984 | Schmitt et al. | 57/348 X |
| 4,704,858 | 11/1987 | Naylor et al. | 57/339 X |

FOREIGN PATENT DOCUMENTS

| | | |
|---|---|---|
| 0219246 | 4/1987 | European Pat. Off. . |
| 2606198 | 11/1977 | Fed. Rep. of Germany . |

*Primary Examiner*—Daniel P. Stodola
*Assistant Examiner*—William T. Stryjewski
*Attorney, Agent, or Firm*—Ostrolenk, Faber, Gerb & Soffen

[57] ABSTRACT

A friction false twisting unit having three spindles and respective plurality of disks on each spindle. One spindle and its disks are on a swingable housing which swings out with respect to a stationary housing holding the other two spindles. A lower thread guide is beneath the lowest disk on the first spindle on the swingable housing. The lower thread guide eyelet opening opens toward the front spindle on the stationary housing. The lowest disk on that spindle is a thread guide disk, not a texturing disk. An upper stationary thread guide above the disks has an eyelet opening toward the rear of the housing and toward a respective lateral side of the housing depending upon whether an S twist or a Z twist is being applied to the thread, and the center of the eyelet opening of the upper thread guide is off the center of the triangle defined by the spindles.

16 Claims, 4 Drawing Sheets

THREADING A FRICTION FALSE TWISTING UNIT

BACKGROUND OF THE INVENTION

The present invention relates to a friction false twisting unit for the false twisting of threads by means of friction disks on three spindles arranged in a triangle. One set of the friction disks is arranged so that it may be swung out from and toward the spindle triangle and a lower thread guide is arranged on the housing of the swingable disk set.

One example of such a false twisting unit is shown in Patent EPO 2 19 246 A1. One set of the disks can be opened for insertion of a thread. This is required particularly in the case of twisting units which are equipped with disks of soft material since the already travelling thread cuts into the disks which have not yet started spinning. For threading, a set of disks is swung out of the disk triangle, and the thread is inserted by hand into the triangle which has not yet been closed. The swung out set of disks is then swung in closing the triangle in order that the thread should remain in the triangle. Swingable thread guides are arranged below and above the disks. The thread guides are swung into the triangle after completion of the threading. During this type of threading in the prior art, upon the swinging inward of the disk set, that is, when the thread receives its full twist, the thread is frequently thrown out of the triangle and even tears. The above process must therefore be repeated several times, which is very time consuming, especially since one machine may be equipped with more than 200 thread texturing places for which swingable disk sets are used.

In the present invention, the thread guide is arranged in the housing of the swingable disk set. The thread guide disk, which on either S or Z twisting is the lowermost disk of all the disk sets, is arranged to the right of the thread guide on the front of the stationary housing. An upper thread guide is arranged stationary. It has an eyelet opening which faces toward the right upon S twisting. The center of the eyelet is also shifted toward the right rear from the center of the disk triangle. The eyelet opening of the thread guide faces toward the left rear upon Z twisting. The eyelet center is shifted to the left rear from the center of the disk triangle.

SUMMARY OF THE INVENTION

It is the object of the invention to enable the introduction of thread in a secure manner into the texturing triangle of friction disks on spindles of a friction false twisting unit without the thread leaving the triangle again or tearing.

The friction false twisting unit of the present invention includes an array of three spindles in a triangle with a set of working disks or friction disks on each of the spindles. The spindles are so placed and the disks are so shaped as to cause the disks on the three spindles to be interleaved. Conventionally, the disks alternate from spindle to spindle in a sequence defining a helix selected for applying either an S or a Z twist to the thread passing the disks. In order to prevent damage to the thread and/or to the disks, and particularly damage to the lowest disk, during threading, the lower thread guide is associated with one of the spindles, e.g. it is on a housing along with the one spindle, so that the one spindle, the thread guide and their housing are movable away from the other spindles, which may be supported on a stationary housing. The movement may be a swinging or pivoting movement. An upper thread guide above all of the disks is stationary and has an eyelet opening that is stationary.

The one spindle, its disks, and the lower thread guide are swingable outward with respect to the other spindles. The one spindle is toward the front side of the spindle triangle. The lower thread guide is arranged on the swingable housing at one lateral side, e.g. the left hand side, which is where the swingable disk set housing is located. The lower thread guide grasps the thread after it has been threaded and guides the thread into the center of the disk triangle as the swingable spindle and the lower thread guide are swung in.

The first or lowermost thread guide disk on a second spindle, which is also toward the front of the triangle as seen from the operating side, is the disk and spindle toward which the swingable first spindle and the lower thread guide are swung. When the swingable spindle is to the left front, the second spindle is to the right front and to the right of the thread guide. That lowermost thread guide is not a thread texturing disk, but is instead smooth surfaced to guide the thread.

Upon S-twisting of the thread, the working disks follow helically upward along successive disks on each of the spindles in turn. Upon Z-twisting of the thread, the working disks follow helically downward.

The stationary thread guide at the upper end of the false twisting unit points, upon S-twisting, with its eyelet opening toward the right rear, as seen from the operating side. The center of the eyelet is also shifted toward the right and the rear and off the center of the disk triangle. Upon Z-twisting, the thread guide eyelet of the upper thread guide opens toward the left rear. The center of the eyelet in this case is also shifted toward the left and the rear and off the center of the disk triangle.

The arrangement described can also be reversed symmetrically, i.e. the swingable housing can be opened to the right and the spindle on the right is swingable.

There may be a combined housing supporting the spindles upstanding and parallel. Two of the spindles are on the stationary housing part, one toward the front and toward one side of the stationary housing part and one toward the rear of the stationary housing. One of the spindles is on a swingable housing, which is swingably attached to the stationary housing and is swingable outward and inward to open and close the spindle triangle.

The invention is hereinafter further detailed and the objects and operation are further described after the following brief description of the drawings.

DETAILED DESCRIPTION OF THE INVENTION

Figure 1:
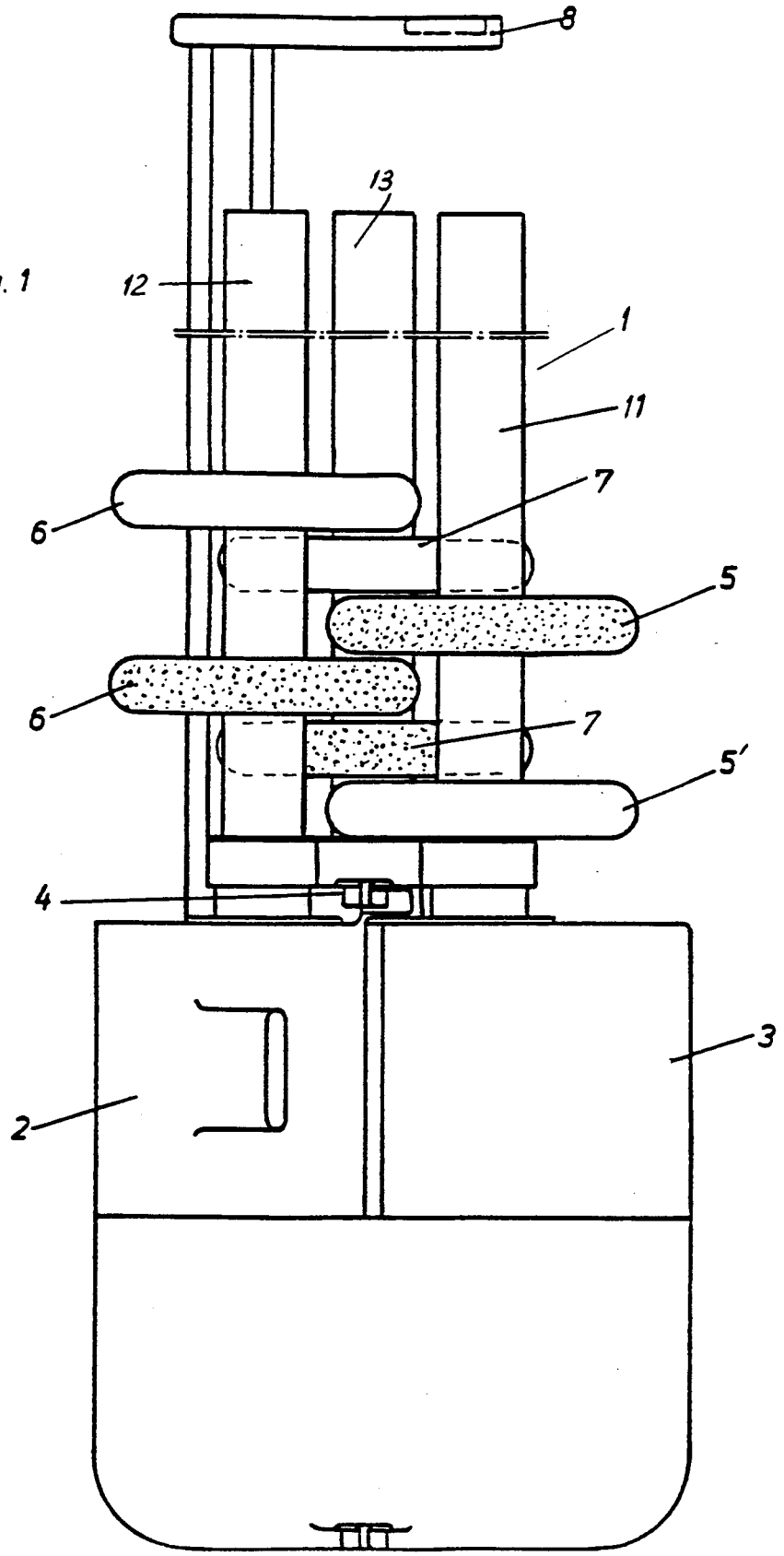
FIG. 1 is a partial view of a friction false twisting unit according to the invention for S-twisting.
Figure 3:
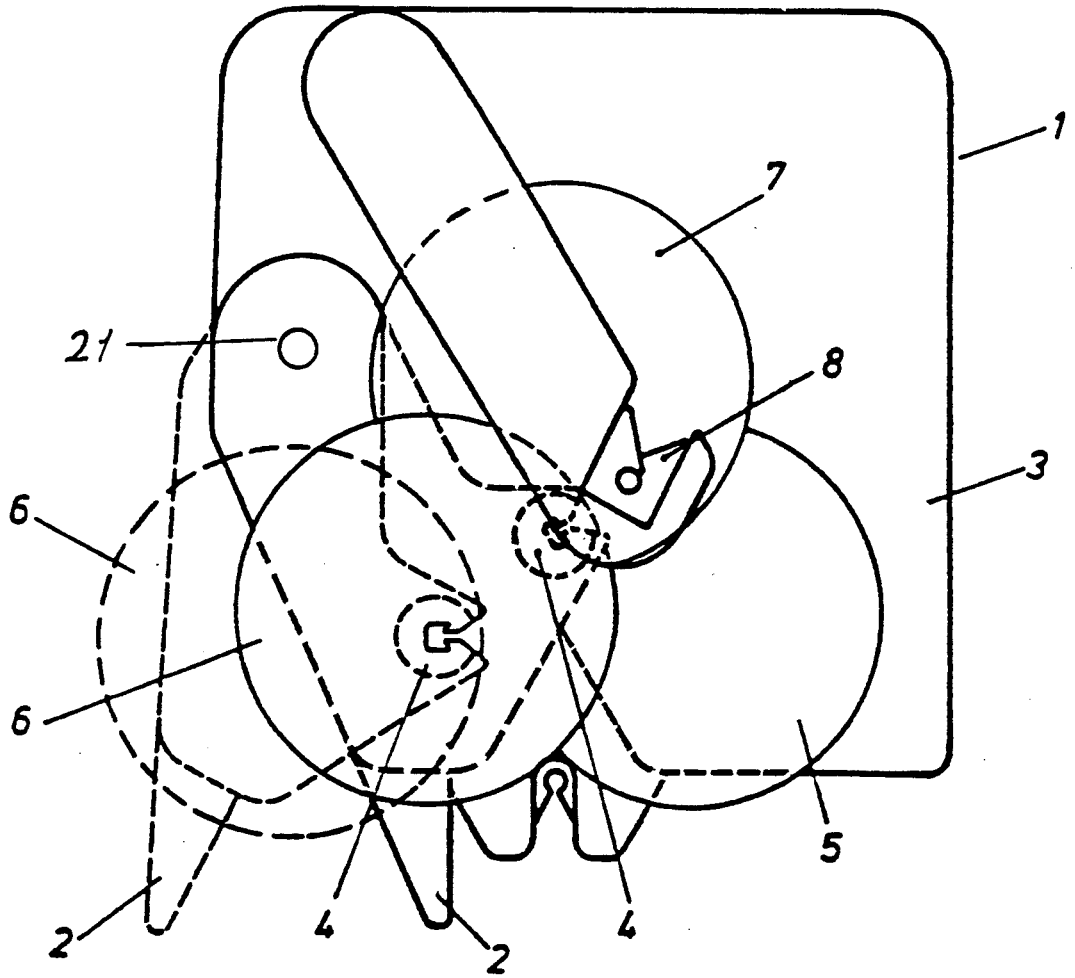
FIG. 3 is a top view of the unit for S-twisting.

FIGS. 1 and 3 are partial views of a false twisting unit 1 for performing S-twisting of the thread (not shown). A combined spindle support housing includes a larger stationary housing 3 and a swingable housing 2 at the left front side of the stationary housing and pivotally attached to the stationary housing at a swing pivot 21 placed for enabling opening and closing of a spindle triangle, as described below. The stationary housing has a front side, an opposite rear side and lateral sides that join the front and rear sides. A lower thread guide 4 is arranged on the swingable housing 2. It has an eyelet which opens in the general direction of inward swinging of the swingable housing for engaging thread as the swingable housing is swung inward. The thread guide 4 is vertically below all of the disks on all of the disk spindles.

There are three disk spindles 11, 12 and 13, which extend upward, are parallel and are placed to define an equilateral triangle in top view. Each spindle carries a respective plurality of spinnable thread working or texturing disks 5, 6 and 7, arranged up the spindles. The disks 5, 6 and 7 are rough surfaced, as suggested in the drawings, for distributing rotations to the threads passing by. Those disks may be comprised of polyurethane (plastic), or of a refractory material (e.g. a ceramic) or may be coated with an abrasive (e.g. a diamond). The disks are caused to spin in a known manner, by rotation of their spindles in selected respective directions for accomplishing a particular false twist. This rotation is caused by means of a known belt and belt connection drive, not shown.

The lowermost disk 5' on the spindle 11 is a thread guide disk arranged above the stationary housing 3. The disk 5' is not a texturing disk. It is, therefore, generally smooth surfaced, e.g. aluminum coated with smooth chroming, to guide without rubbing the thread exessively. The thread guide 4 moves in beneath that lowest disk 5' and moves the thread first against the side of that disk 5'.

Above the bottom guide disk 5', the other disks 5 on that spindle 11 are working disks, surface textured to apply a false twist, like disks 6 and 7. The working disks 5, 6 and 7 are each of such diameter and the spindles 11, 12 and 13 are so positioned that the disks of the three spindles are interleaved with a disk from each of the three spindles in turn being the next disk upward, and with the disks along the spindles being sequenced to define a left hand or counterclockwise helix upward along the spindles to provide an S-twist to thread.

Figure 2:
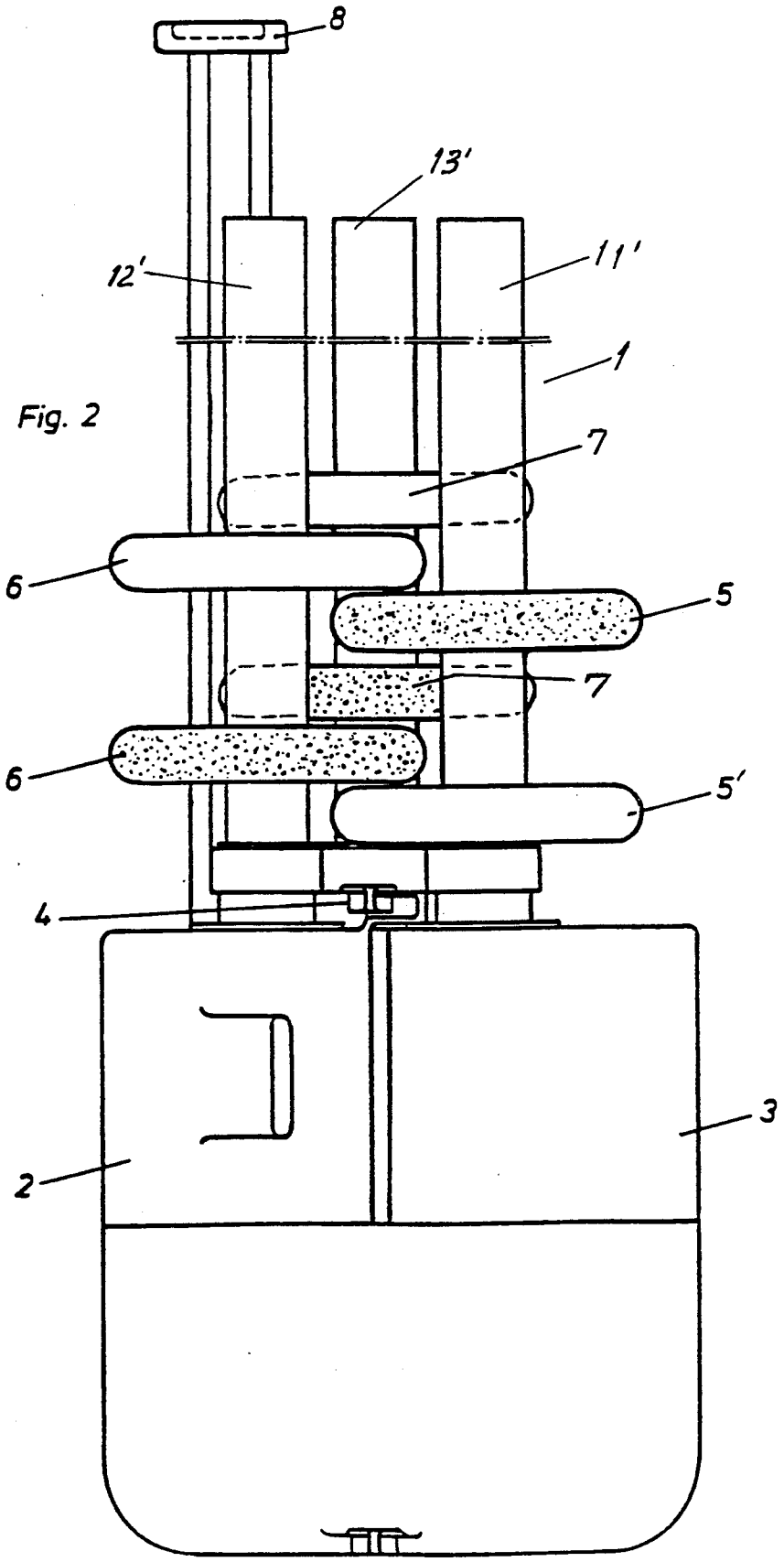
FIG. 2 is a partial view of a friction false twisting unit according to the invention for Z-twisting.

FIG. 2 shows the same section of a false twisting unit as shown in FIG. 1, but designed to provide a Z-twist to the thread. The thread guide disk 5' in FIG. 2 is again positioned to the front of the housing 2 and to the right of the swingable thread guide 4. The working disks 5, 6 and 7 on the spindles 11', 12' and 13' are also interleaved, but the disks along the spindles are sequenced to define a left hand or counterclockwise helix downward along the spindle.

FIG. 3 is a top view of the false twisting unit for S-twisting, as shown in FIG. 1. In the dashed line position, the swingable housing 2 is pivoted open, the triangle of spindles is open and the thread guide 4 is shown before the threading. To the right of the thread guide 4 in FIG. 3 is the thread guide disk 5' (hidden under disks 5) past which the working disks 6 and 7 move.

The upper thread guide 8 is stationary on the stationary housing 3, is above all of the working disks 5, 6 and 7 and has an open eyelet side that points generally toward the right and toward the rear, away from the working disk 6. The center of the eyelet is also shifted toward the right and the rear off the center of the thread triangle or spindle triangle.

Figure 4:
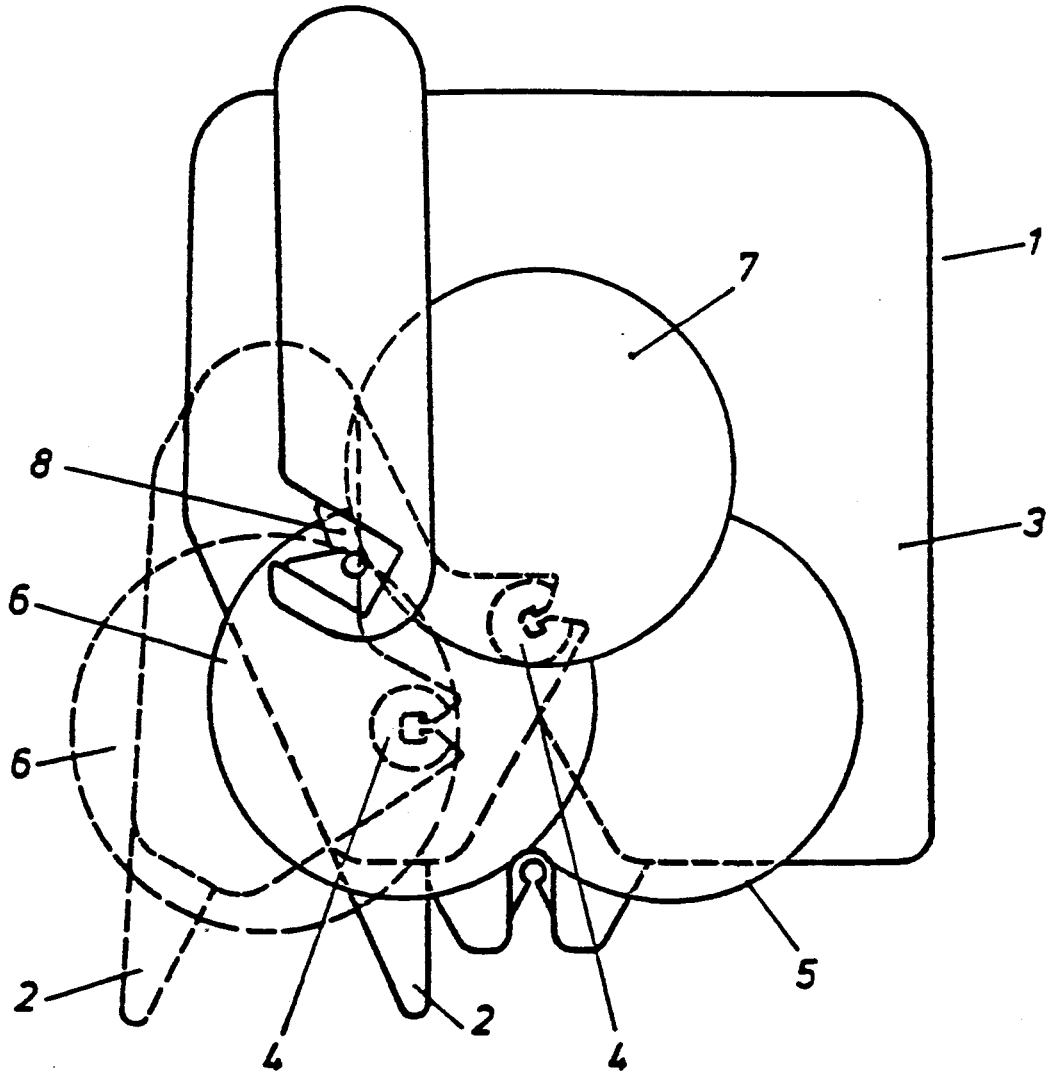
FIG. 4 is a top view of the unit for Z-twisting.

FIG. 4 shows a top view of the false twisting unit 1 for Z-twisting, as shown in FIG. 2. The open condition of the swingable housing 2 is also indicated in dashed line. In the closed condition, the center of the eyelet opening of the swingable lower thread guide 4 is in the center of the thread triangle or spindle triangle.

The open side of the upper thread guide 8 in the case of the Z-direction of twisting faces toward the left and toward the rear away from the working disks 5 on spindle 11'. The center of the eyelet of the upper thread guide is shifted toward the left and the rear off the center of the thread triangle or spindle triangle.

Either of the two embodiments of FIGS. 1, 3 or 2, 4 may be revised symmetrically. For example, the swingable housing would be on the right, and the spindle on that housing and the lower thread guide would also be to the right, while the lowermost disk above the thread guide would be on the left.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A friction false twisting unit for the false twisting of thread, the unit comprising:

a combined housing including a stationary housing and a swingable housing;

the stationary housing having a front side, an opposite rear side and sides joining the front and rear sides;

the swingable housing being swingably connected to swing out from one side of the stationary housing; the swingable housing being at least in part located toward the front side of the stationary housing;

three upstanding disk spindles arranged in a triangle, the triangle having a center, with the first spindle on the swingable housing and toward the front of the stationary housing, a second spindle on the stationary housing toward the front of the stationary housing and a third spindle on the stationary housing and to the rear of the second spindle;

a respective plurality of spinnable friction disks on each spindle, the spindles being so placed and the disks being of such relative sizes that with the swingable housing swung in toward the stationary housing, the disks on the three spindles are interleaved; the disks on the spindles alternating in sequence from spindle to spindle and being arranged along the spindles in a sequence which is generally helical in the sequence from spindle to spindle for providing the thread with a particular twist;

a lower thread guide on the swingable housing below a lowest one of the disks on the first spindle; a thread guide disk disposed on the second spindle as the lowest disk thereon and arranged to a side of the lower thread guide that is toward the stationary housing and being placed so that when the swingable housing is swung in toward the stationary housing, the lower thread guide moves beneath the thread guide disk on the second spindle;

an upper thread guide on the stationary housing and having an eyelet opening for thread, the eyelet opening facing generally rearwardly and toward a selected side of the stationary housing that is selected to correspond with a direction of false twist of the thread as established by the sequence of the disks on the spindles, the eyelet opening of the upper thread guide being shifted rearwardly toward the selected side, being spaced more toward the selected side than is the lower thread guide and being off the center of the triangle of the spindles.

2. The friction false twisting unit of claim 1, wherein the lower thread guide is centered on the center of the spindle triangle when the swingable housing is swung toward the stationary housing.

3. The friction false twisting unit of claim 2, wherein the upper thread guide is held stationary while the lower thread guide swings.

4. The friction false twisting unit of claim 1, wherein the lower thread guide has an eyelet opening which opens facing toward the stationary housing.

5. The friction false twisting of claim 4, wherein the disks are sequenced along their respective spindles so as to give the thread passing by the disks an S twist;

the swingable housing is toward the front and when facing the front, at the left side of the stationary housing, the lower thread guide eyelet opening opens toward the right side when facing the front and toward the stationary housing, and the upper thread guide eyelet opening faces toward the right side when facing the front and is shifted toward the right side when facing the front and the rear off the center of the triangle of the spindles.

6. The friction false twisting unit of claim 4, wherein the disks are sequenced along their respective spindles so as to give the thread passing by the disks an S twist;

the swingable housing is toward the front and at a first lateral side of the stationary housing, the lower thread guide eyelet opening opens toward the stationary housing, and the upper thread guide eyelet opening faces toward the second opposite lateral side and is shifted toward the second lateral side and the rear off the center of the triangle of the spindles.

7. The friction false twisting unit of claim 4, wherein the disks are sequenced along their respective spindles so as to give the thread passing by the disks a Z twist;

the swingable housing is toward the front and when facing the front, at the left side of the stationary housing, the lower thread guide eyelet opening opens toward the right side when facing the front and toward the stationary housing, and the upper thread guide eyelet opening faces toward the left side when facing the front and is shifted toward the left side when facing the front and the rear off the center of the triangle of the spindles.

8. The friction false twisting unit of claim 4, wherein the disks are sequenced along their respective spindles so as to give the thread passing by the disks a Z twist;

the swingable housing is toward the front and at a first lateral side of the stationary housing, the lower thread guide eyelet opening opens toward the stationary housing, and the upper thread guide eyelet opening faces toward the first lateral side and is shifted toward the first lateral side and the rear off the center of the triangle of the spindles.

9. The friction false twisting unit of claim 4, wherein the eyelet openings of the swingable lower thread guide faces the center of the triangle of the spindles and has a center, the center of the eyelet opening of the swingable lower thread guide being coincident with the center of the spindle triangle when the swingable housing is swung into position toward the stationary housing.

10. The friction false twisting unit of claim 1, wherein the upper thread guide is held stationary while the lower thread guide swings.

11. The friction false twisting unit of claim 1, wherein the thread guide disk has a smooth surface where it contacts thread.

12. A friction false twisting unit for the false twisting of thread, the unit comprising:

first, second and third disk spindles and means supporting the spindles upstanding, parallel and arranged in a triangle, the triangle having a center, a fist one of the spindles being supported on the supporting means for being moved away from and back toward two others of the three spindles for selectively respectively opening and closing the spindle triangle; the first spindle and a second of the spindles defining a front side of the spindle triangle and a third one of the spindles being rearward of the first and second spindles in the spindle triangle;

a respective plurality of spinnable friction disks on each spindle, the spindles being so placed and the disks being of such relative sizes, that with the first spindle in toward the second and third spindles, the disk on the three spindles are interleaved; the disks on the spindles alternating in sequence from spindle to spindle and being arranged along the spindles in a sequence which is generally helical in the sequence from spindle to spindle for providing the thread with a particular twist;

a lower thread guide disposed below a lowest one of the disks on a first spindle and movable along with the first spindle toward and away from the other two spindles; a thread guide disk disposed on the second spindle as the lowest disk thereon and arranged to a side of the lower thread guide that is toward the second spindle and being so placed that when the first spindle is moved in toward the second and third spindles, the lower thread guide moves beneath the thread guide disk on the second spindle;

an upper thread guide supported stationary with respect to the movement of the first spindle, the upper thread guide having an eyelet opening for thread, the eyelet opening facing generally rearwardly and toward a lateral side of the spindle triangle that is selected to correspond with a direction of twist of the thread as established by the sequence of the disks on the spindles, the eyelet opening of the upper thread guide being shifted toward the rear and toward the selected side of the spindle triangle, being spaced more toward the selected side than is the lower thread guide and being off the center of the triangle of the spindles.

13. The friction false twisting unit of claim 12, wherein the lower thread guide is centered on the center of the spindle triangle when the first spindle is toward the second and third spindles.

14. The friction false twisting unit of claim 12, wherein the lower thread guide has an eyelet opening which opens facing toward the second spindle.

15. The friction false twisting unit of claim 14, wherein the eyelet opening of the lower thread guide faces the center of the spindle triangle, and the center of the second eyelet is generally at the center of the spindle triangle with the first spindle toward the second and third spindles.

16. The friction false twisting unit of claim 12, wherein the thread guide disk has a smooth surface where it contacts thread.

* * * * *